US009677191B2

(12) United States Patent
Van Den Bossche

(10) Patent No.: US 9,677,191 B2
(45) Date of Patent: Jun. 13, 2017

(54) DEVICE SUITABLE FOR THE ELECTROCHEMICAL PROCESSING OF AN OBJECT, A HOLDER SUITABLE FOR SUCH A DEVICE, AND A METHOD FOR THE ELECTROCHEMICAL PROCESSING OF AN OBJECT

(71) Applicant: Elsyca N.V., Wijgmaal (Leuven) (BE)

(72) Inventor: Bart Juul Wilhelmina Van Den Bossche, Putte (BE)

(73) Assignee: Elsyca N.V., Wijgmaal (Leuven) (BE)

( * ) Notice: Subject to any disclaimer, the term of this patent is extended or adjusted under 35 U.S.C. 154(b) by 708 days.

(21) Appl. No.: 13/743,937

(22) Filed: Jan. 17, 2013

(65) Prior Publication Data

US 2014/0197035 A1 Jul. 17, 2014

(51) Int. Cl.

| | |
|---|---|
| ***C25D 17/00*** | (2006.01) |
| ***C25D 17/12*** | (2006.01) |
| ***C25D 21/12*** | (2006.01) |
| ***C25F 7/00*** | (2006.01) |
| *C25D 5/08* | (2006.01) |

(52) U.S. Cl.
CPC ..... *C25D 21/12* (2013.01); *C25D 17/007* (2013.01); *C25D 17/12* (2013.01); *C25F 7/00* (2013.01); *C25D 5/08* (2013.01)

(58) Field of Classification Search
CPC ..... C25D 17/007; C25D 17/12; C25D 7/00; C25D 5/08; C25F 7/00
USPC ..... 204/297.01, 641, 230.2
See application file for complete search history.

(56) References Cited

U.S. PATENT DOCUMENTS

| | | | | |
|---|---|---|---|---|
| 3,372,099 | A * | 3/1968 | Clifford | 205/641 |
| 4,052,284 | A * | 10/1977 | Schrader | 204/224 M |
| 6,497,801 | B1 | 12/2002 | Woodruff et al. | |
| 2005/0045252 | A1 | 3/2005 | Yamasaki et al. | |
| 2007/0068819 | A1 * | 3/2007 | Singh et al. | 205/83 |
| 2011/0125050 | A1 | 5/2011 | Bau et al. | |

FOREIGN PATENT DOCUMENTS

| | | |
|---|---|---|
| DE | 10132408 | 2/2003 |
| FR | 1396638 | 4/1965 |
| WO | 2006027311 | 3/2006 |
| WO | 2006127320 | 11/2006 |
| WO | 2008152506 | 12/2008 |

OTHER PUBLICATIONS

International Search Report dated Jul. 12, 2013, relating to European Application No. 13151054/.
International Search Report dated Jan. 9, 2012, for NL 2007221.
J. Deconinck et al, Benefits of Modelling for the Electroplating Industry, Galvanotechnik, May 2007, six pages.

* cited by examiner

*Primary Examiner* — Stefanie S Wittenberg
(74) *Attorney, Agent, or Firm* — Barnes & Thornburg LLP

(57) ABSTRACT

A device suitable for the electrochemical processing of an object is at least provided with a chamber that is to accommodate an electrolyte, a support for the object that is to be processed in the chamber, at least one set of electrodes located in the chamber such that during operation at least one electrode is located opposite each portion of a surface of said object that is to be processed. The device also includes a controller configured to provide an electric current between the object that is to be processed and the electrodes.

15 Claims, 13 Drawing Sheets

Figure 1:
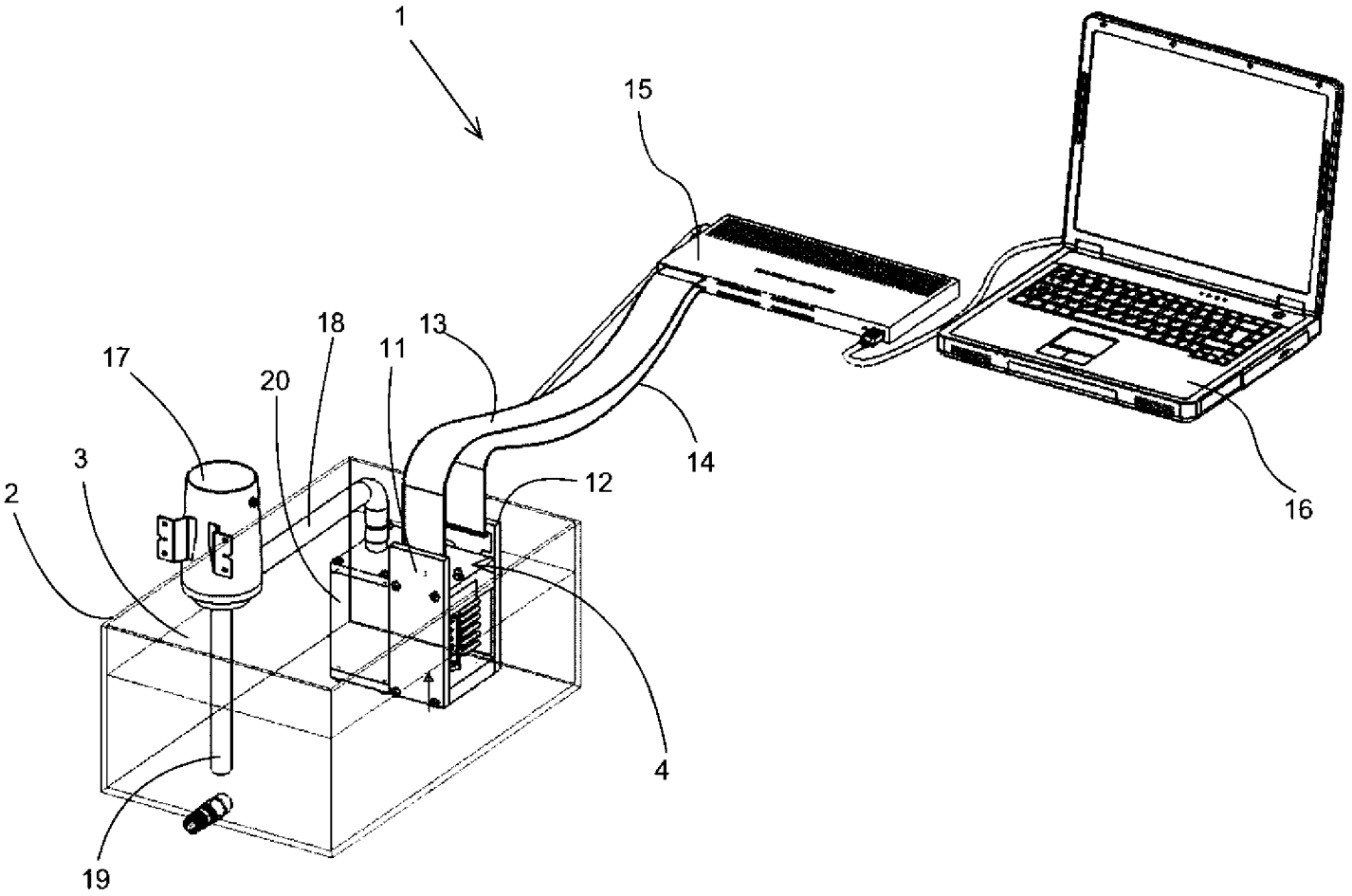

DEVICE SUITABLE FOR THE ELECTROCHEMICAL PROCESSING OF AN OBJECT, A HOLDER SUITABLE FOR SUCH A DEVICE, AND A METHOD FOR THE ELECTROCHEMICAL PROCESSING OF AN OBJECT

The invention relates to a device suitable for the electrochemical processing of an object, which device is at least provided with a chamber that is to accommodate an electrolyte, means for supporting the object that is to be processed in said chamber, at least one set of electrodes extending parallel to each other, which electrodes are located in said chamber such that during operation at least one electrode is located opposite each portion of a surface of said object that is to be processed, as well as control means for providing an electric current between the object that is to be processed and the electrodes.

The invention also relates to a holder suitable for such a device and a method for the electrochemical processing of an object with such a device.

Such a device and method are suitable for applying a layer on the object or renders remove a layer thereof.

In such a device which is known from WO2006027311A1, the electrodes are located in a raster pattern wherein the distances between the tips of all electrodes are equal, either with respect to each other or with respect to the surface of the object to be processed.

When objects with a relatively complex shape such as for example a turbine blade need to be plated with platinum, it is extremely important that the realized layer thickness of the platinum over the whole surface is as close as possible to the desired layer thickness to prevent excessive plating of the metal, especially because of the high prices of the platinum.

When positioning all electrodes in a rectangular matrix with spacings $\Delta x$ and $\Delta y$ that is either equal in each principal direction x and y, or either related (inversely proportional) to the substrate area in front of the tip of the electrode, it is not possible to provide each electrode with a desired current to obtain a desired layer thickness because:

- if the current density on the tip of the electrode becomes too high the electrode might passivate (e.g. stainless steel, Ni or Ni alloy based electrodes), which would require cleaning or lead to a fast deterioration of the surface;
- near recessed areas, the current density on the surface closest to the electrode would rise much faster than the current density in the recessed area (because further away); hence instead of reaching minimum specifications inside the recessed area, the deposit on the surface closest to the electrode would have a bad quality (rough, powdery, or even burned). In any case the deposit thickness on the surface closest to the electrode would be largely in excess compared to the minimum specifications. Since the prices of precious metals (Pt, Au, Pd, etc) are extremely high, a too thick deposited layer renders the object unnecessary costly.

So with the known device it is not possible to realize the desired layer thickness over the whole object without applying a metal weight, that is far too high and without increasing drastically the process time. The latter also holds true for removing a layer from the object.

It is an object of the invention to provide a device and method for the electrochemical processing of objects with relatively complex shapes, wherein the layer thickness of the applied or removed layer over the whole object is as close as possible to the desired layer thickness.

This object is achieved in the device according to the invention in that the device comprises at least one raster pattern comprising a number of nodes with fixed spacings between the nodes in at least two different directions, wherein a number of electrodes is arranged on the nodes of the raster pattern, whilst at least one electrode is located at a position shifted with respect to the nearest node of the raster pattern.

Due to the shifted electrode, all electrodes are no longer in a complete full raster or matrix. The shifted electrode can be shifted so that it does not coincide with parts of the object which do not need to be processed. The shifted electrode can also be shifted to a position in which it better addresses the surface of the object. The shifted electrode can also be located between the nodes to be able to increase the current density on the surface of the object, without the necessity to increase the current through the electrodes located on the nodes, so that the current per electrode can be limited for practical reasons (avoid fast deterioration or passivation, current range of the steering unit in case of individually steered pens). The shifted electrode can be also be shifted to a position so that another specific part of the object can be treated.

So it is clear that by the device according to the invention additional electrodes are required. It is not a priori possible to define how much electrodes are required for addressing recessed areas and ensuring the minimal thickness specifications, taking into account the fact that the current per electrode is limited for practical reasons. By means of computer simulations each electrode configuration has to be evaluated, and then in an iterative manner electrodes can be reallocated or more electrodes can be defined. Since the electrodes extend parallel to each other, it is relatively easy to manufacture the device after the positions of the electrodes have been determined.

The number of electrodes located at a position shifted with respect to the nearest node of the raster pattern is less than the number of electrodes located on the nodes of the raster pattern, so less than 50% of the total amount of electrodes. Preferably, the number of electrodes located on the nodes of the raster pattern is more than 60% and even more preferably than 70% or 80% of the total amount of electrodes, so that the number of electrodes located at a position shifted with respect to the nearest node of the raster pattern is less than 40% of the total amount of electrodes but more than 0% since at least one electrode is located at a position shifted with respect to the nearest node of the raster pattern.

WO2006127320A2 discloses a device with a number of electrodes which are all located on nodes of a regular pattern. In FIG. 14 of WO2006127320A2, the nodes are located on circles with the same centre and different diameters, with a regular spacing between the nodes on each circle.

An embodiment of the device according to the invention is characterised in that the device comprises at least two sets of electrodes, wherein the electrodes within one set extend parallel to each other, whilst the electrodes of the first and second set extend in different directions.

By such an arrangement the object to be treated is located between the two sets. Such sets can easily be moved with respect to each other so that the object can be positioned between the two sets and be removed therefrom.

Another embodiment of the device according to the invention is characterised in that the electrodes of the first and second set extend in opposite directions but parallel to each other.

By moving one set opposite to the direction in which the electrodes of this set extend, the object can easily be removed from the space between the two sets.

Another advantage of defining the electrodes of the first and second set in opposite directions but parallel to each other is that the design of possible embodiments is simplified and subsequent machining efforts will be reduced.

Another embodiment of the device according to the invention is characterised in that the device comprises at least three sets of electrodes, wherein the electrodes within one set extend parallel to each other, whilst the electrodes of the first, second and third set extend in different directions, whereby the electrodes of the first and second set extend in opposite directions but parallel to each other, whilst the electrodes of the third set extend substantially perpendicular to the electrodes of the first and second set.

By means of the electrodes of the third set, recesses in the object which can not be reached by the first and second set can be addressed. Furthermore if two objects are processed at the same time in the device, the first and second set can be used for the surfaces of the first and second object directed away from each other, whilst the third set can be used for the surfaces of the first and second object directed towards each other.

Another embodiment of the device according to the invention is characterised in that at least one of the electrodes of the third set crosses the electrodes of the first or second set.

In this manner areas of complex surfaces can be reached.

Another embodiment of the device according to the invention is characterised in that the distances between the electrodes within a set are in the same range as the diameter of the electrodes.

With such a distances, a relatively high current density near the object can be realized whilst the electrolyte between the electrodes and between the tips of the electrodes and the surface of the object can easily be refreshed.

Another embodiment of the device according to the invention is characterised in that the electrodes have different lengths.

In this manner the tip of each electrode can be positioned at the same distance form the surface of the object or at any other required distance.

Another embodiment of the device according to the invention is characterised in that at least one electrode is curved.

With curved electrodes, areas like recesses which can not be reached with straight electrodes are accessible.

Another embodiment of the device according to the invention is characterised in that at least one electrode is pen-shaped, wherein the pen-shaped electrode is electrically insulated on the outer side except for the end extending towards the object to be processed.

Since only the end or tip of the electrode is exposed to the electrolyte, a controlled electrical current density on the surface of the object opposite to the electrode will be obtained.

Another embodiment of the device according to the invention is characterized in that at least one electrode is pen-shaped, wherein the pen-shaped electrode comprises a pin-shaped inner electrode, a tube-shaped outer electrode and an insulating layer located between the inner electrode and outer electrode.

Such an electrode is especially suitable as electrode of the third set as mentioned above, whereby the electrode is located between two surfaces of the object(s). The inner and outer electrode will be located opposite different parts of these surfaces and can each be optimized for the respective part.

Another embodiment of the device according to the invention is characterized in that the inner electrode extends outside the outer electrode, wherein the inner electrode and outer electrode are each connected to a separate current source.

Due to the separate current sources, the current for the inner and outer electrode can be different and be optimized for the respective part of the surfaces of the object.

Another embodiment of the device according to the invention is characterized in that the device comprises means to force the electrolyte to flow between the electrodes within of one set.

By forcing the electrolyte to flow between the electrodes and along the surface of the object to be plated, a good refreshment of the electrolyte between the electrodes and along the object surface is obtained.

Another embodiment of the device according to the invention is characterized in that the device is provided with a separate current source for each electrode or group of electrodes such that the electric currents originating from the separate current sources can be supplied by the control means to at least a number of electrodes or a number of groups of electrodes separately and in accordance with predetermined current profiles in time during the electrochemical processing of the object so as to realize a predetermined desired current density distribution across the object.

The desired layer thickness can be a precise value or a range from a minimum allowable layer thickness to a maximum allowable layer thickness to obtain an object with desired functionalities.

Due to the separate current sources, the current for each electrode or group of electrodes can be different and be optimized for the respective parts of the surfaces of the object.

For cost reasons the current per electrode is limited in case a steering unit with individual current sources for each electrode of group of electrodes is being used. For cost reasons a realistic value is 100 mA per electrode.

Another embodiment of the device according to the invention is characterized in that the electric potential on each electrode can be measured when a predetermined current is injected through the electrode, wherein the device is further provided with means for checking whether the measured value corresponds to an expected value.

Given a certain electrolyte at a certain operating temperature, the potential of each electrode will be in a certain range, for example 2.5 V when a fixed current of for example 10 mA is imposed. When the measured potential is much lower, it is a strong indication that the electrode makes contact with the object. This might cause burning of the electrode and/or the applied layer on the object. The electrode need to be re-adjusted On the other hand, when the measured potential is much higher, it is a strong indication that a film (sludge) has been formed on the electrode, or that the electrode is even completely passivated by an oxide film, or that the electrode is poorly contacted at its back end. In this case, the electrode needs to be cleaned or replaced.

The invention also relates to a holder suitable for a device according to one of the preceding claims, which holder comprises at least one set of electrodes extending parallel to each other, characterized in that the holder comprises at least one raster pattern comprising a number of nodes with fixed spacings between the nodes in at least two different directions, wherein a number of electrodes is arranged on the nodes of the raster pattern, whilst at least one electrode is located at a position shifted with respect to the nearest node of the raster pattern.

Such an holder can be used as a replacement element for the device according to the invention.

The invention also relates to a method which is characterized in that the device comprises at least one raster pattern comprising a number of nodes with fixed spacings between the nodes in at least two different directions, wherein a number of electrodes is arranged on the nodes of the raster pattern, whilst at least one electrode is located at a position shifted with respect to the nearest node of the raster pattern, wherein when a calculated expected or a realized layer thickness of the layer deposited on or removed from the object differs from the desired layer thickness, the positions of the electrodes are recalculated and the electrodes are being rearranged.

The desired layer thickness can be a precise value or a range from a minimum allowable layer thickness to a maximum allowable layer thickness to obtain an object with desired functionalities.

The positions will be recalculated and the electrodes will be rearranged until the difference is below the predetermined value. The desired layer thickness can be constant over the whole surface of the object or can vary over the object in a predetermined way to limit the amount of material of the deposited layer.

Figure 2A:
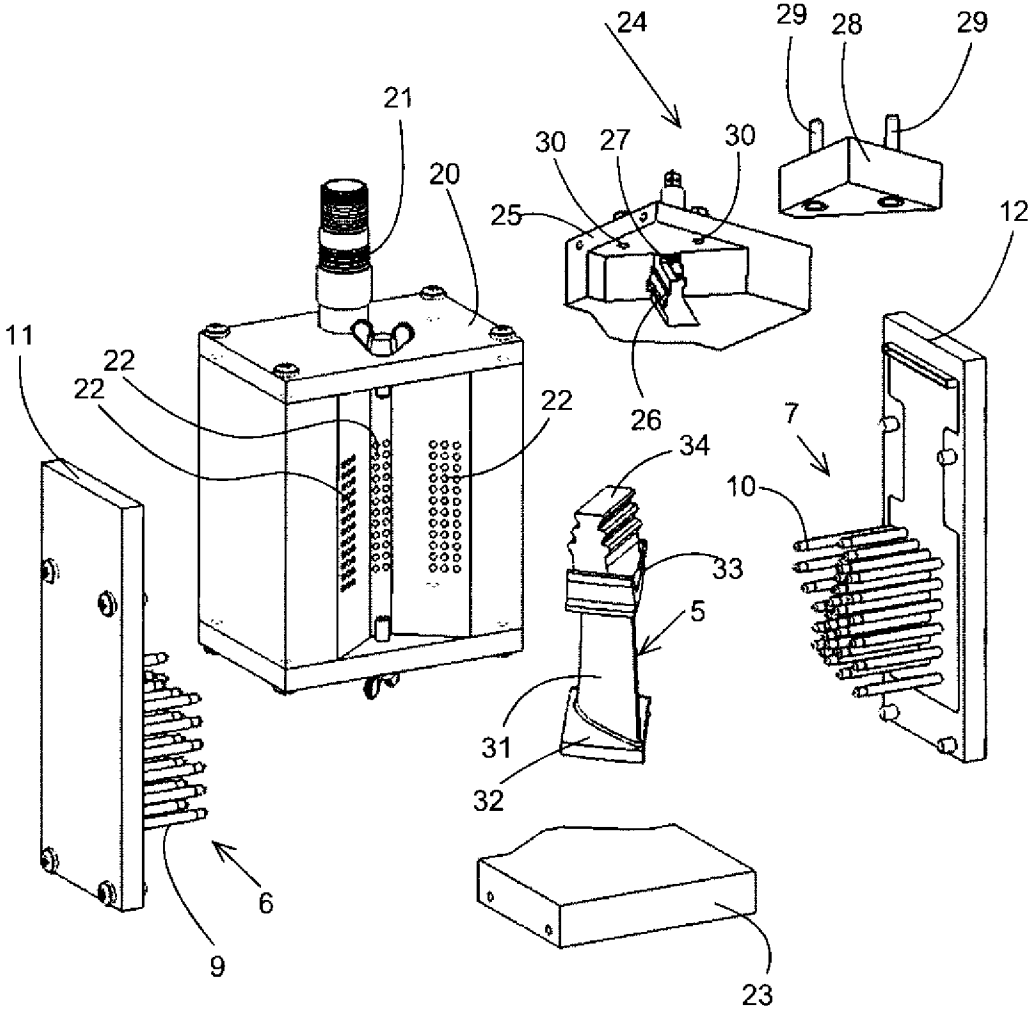
Figure 2C:
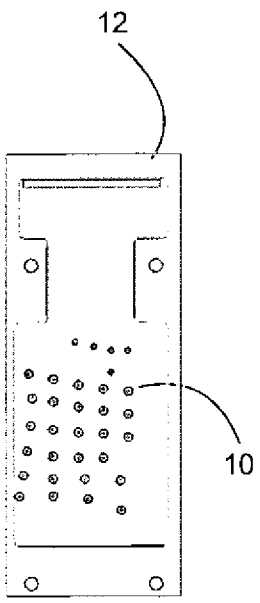
Figure 2B:
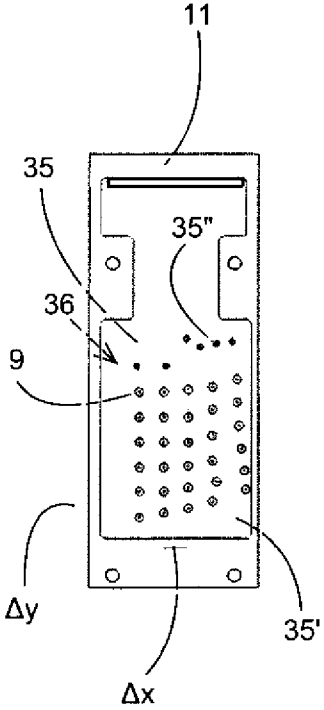
Figure 3:
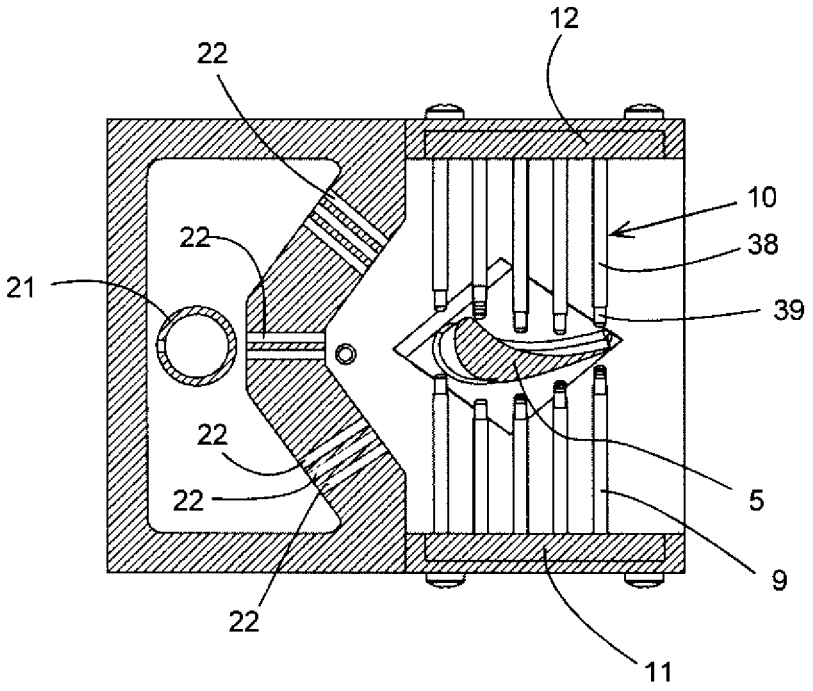
Figure 4:
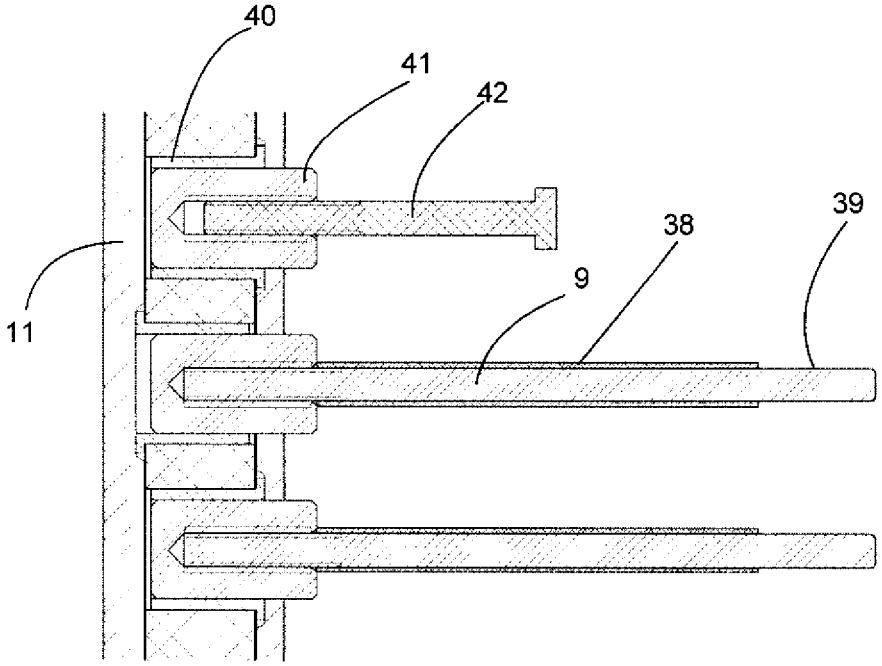
Figure 5A:
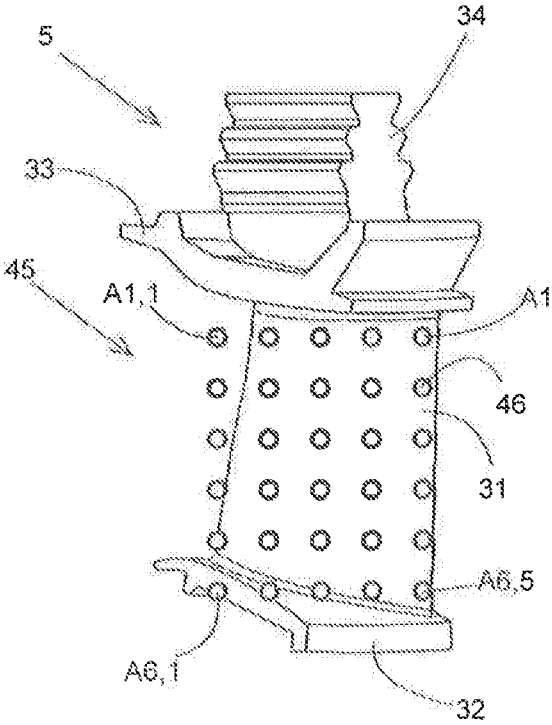
Fig. 5A PRIOR ART
Figure 5B:
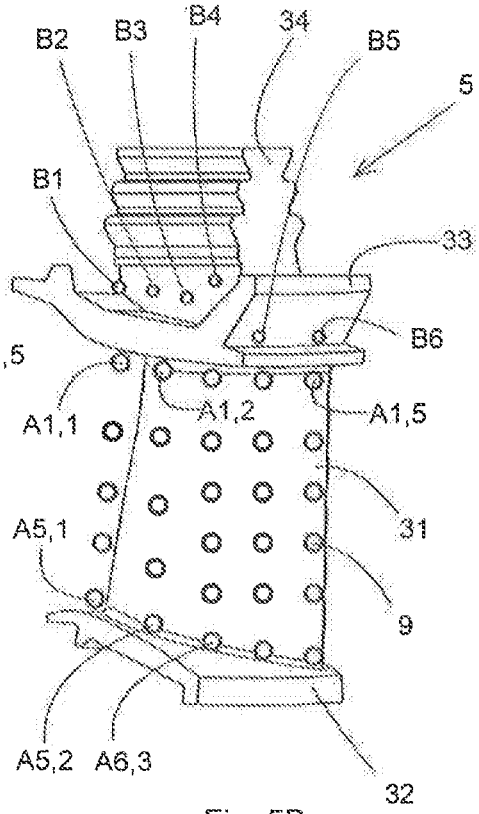
Figure 6A:
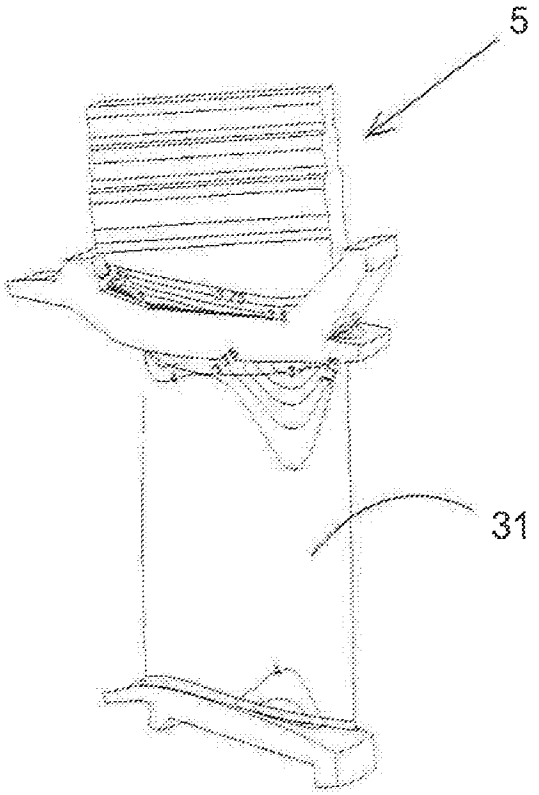
Fig. 6A PRIOR ART
Figure 6A:
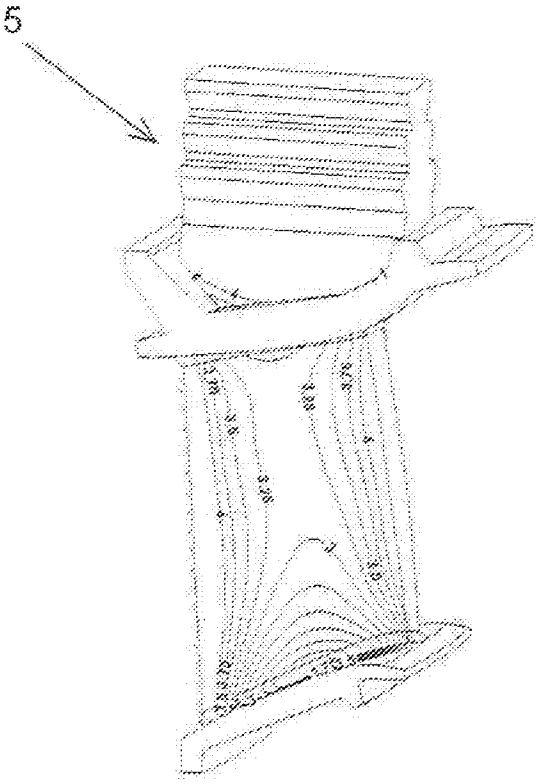
Fig. 6A PRIOR ART
Figure 6B:
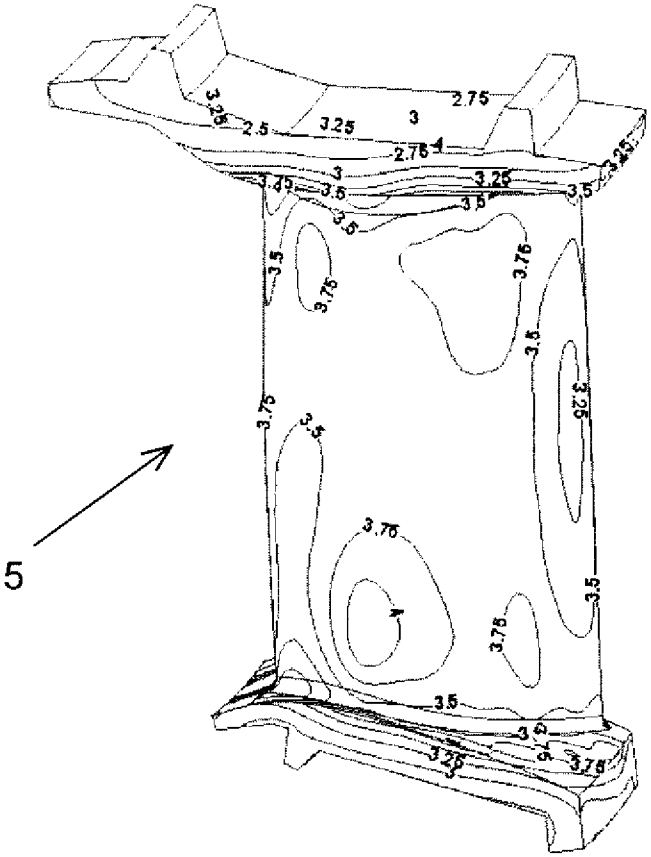
Figure 6B:
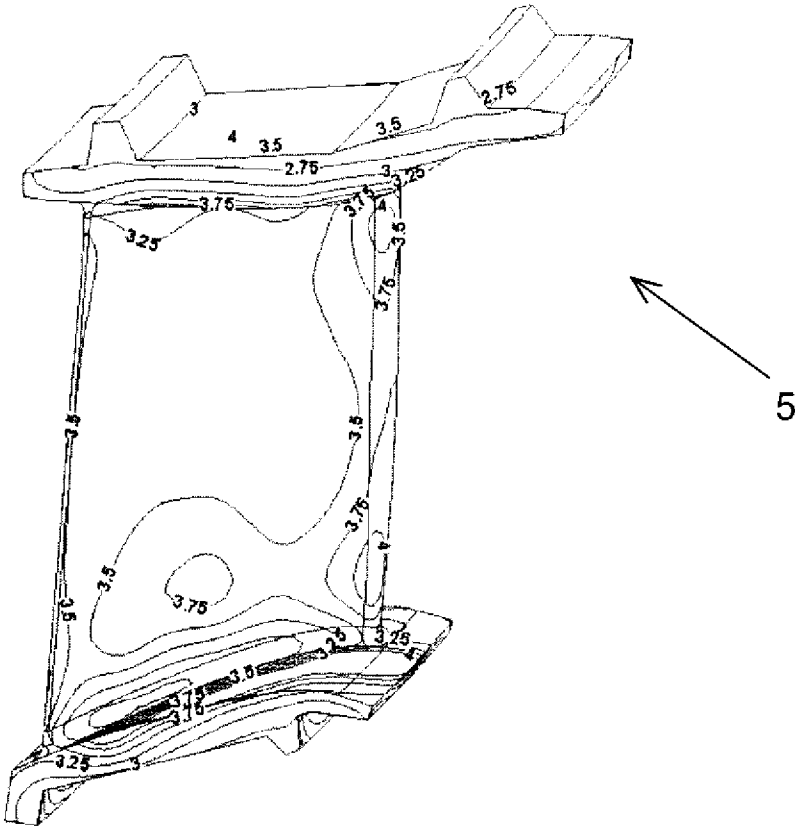
Figure 6C:
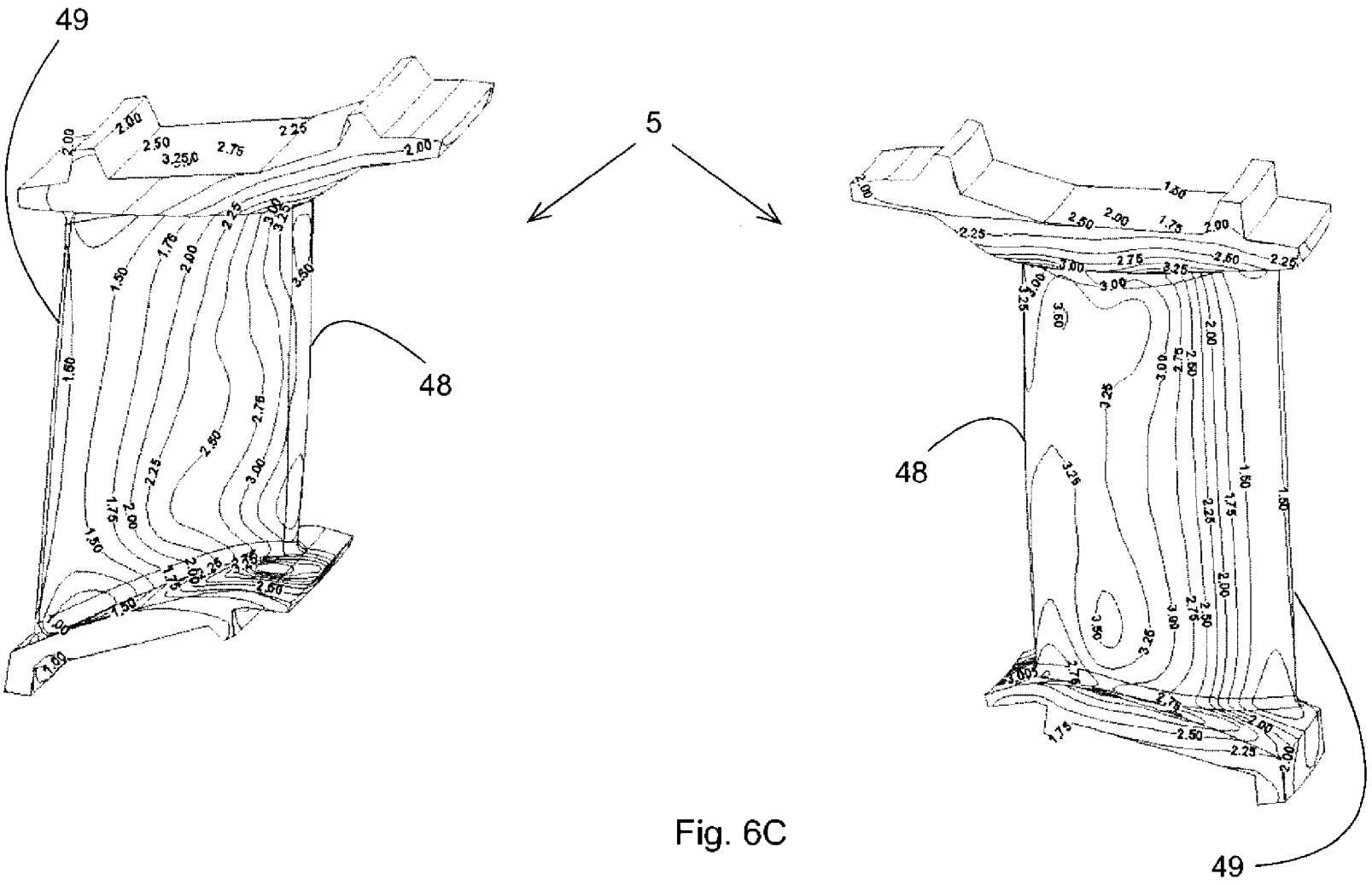
Figure 6D:
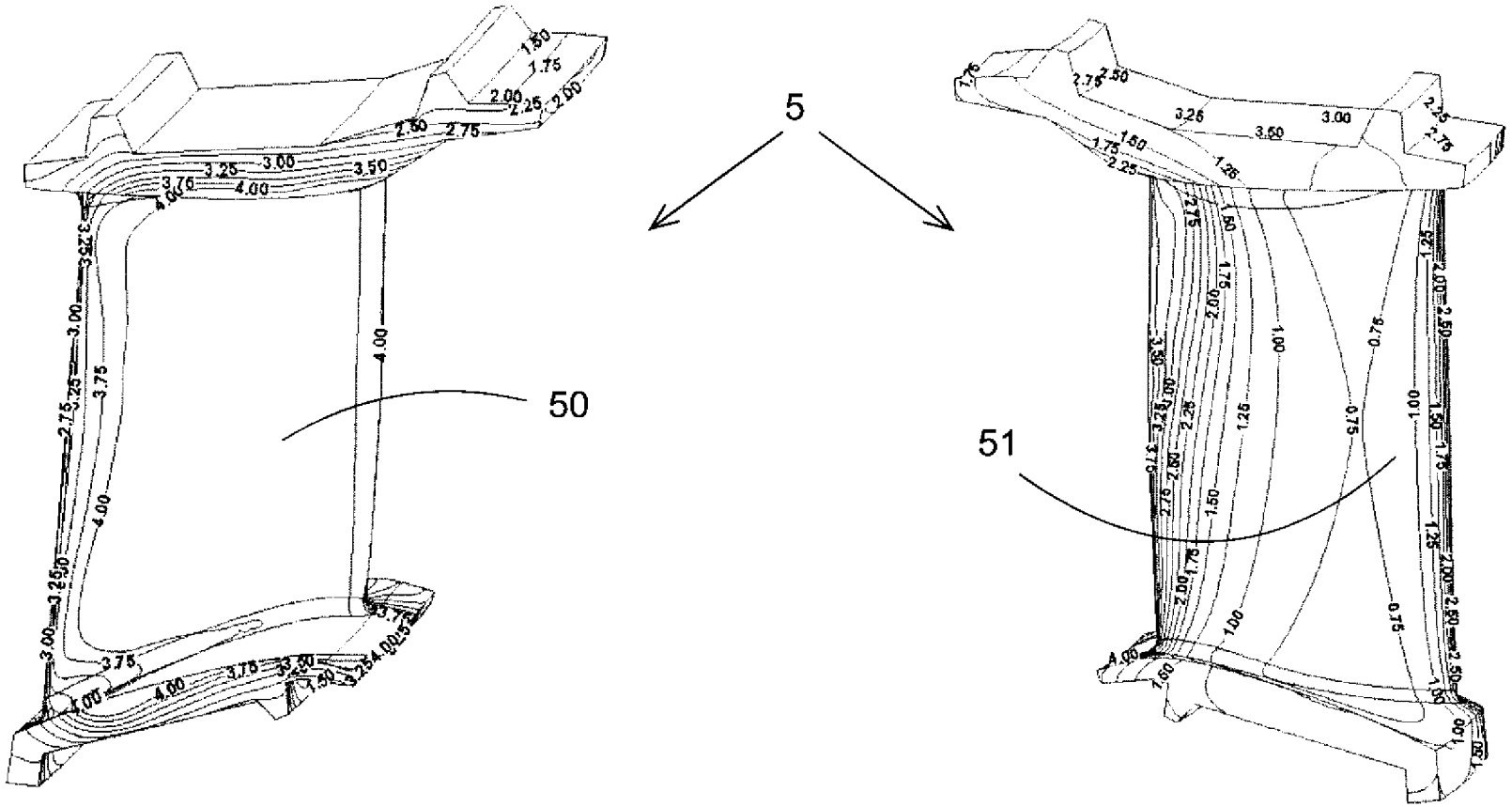
Figure 7:
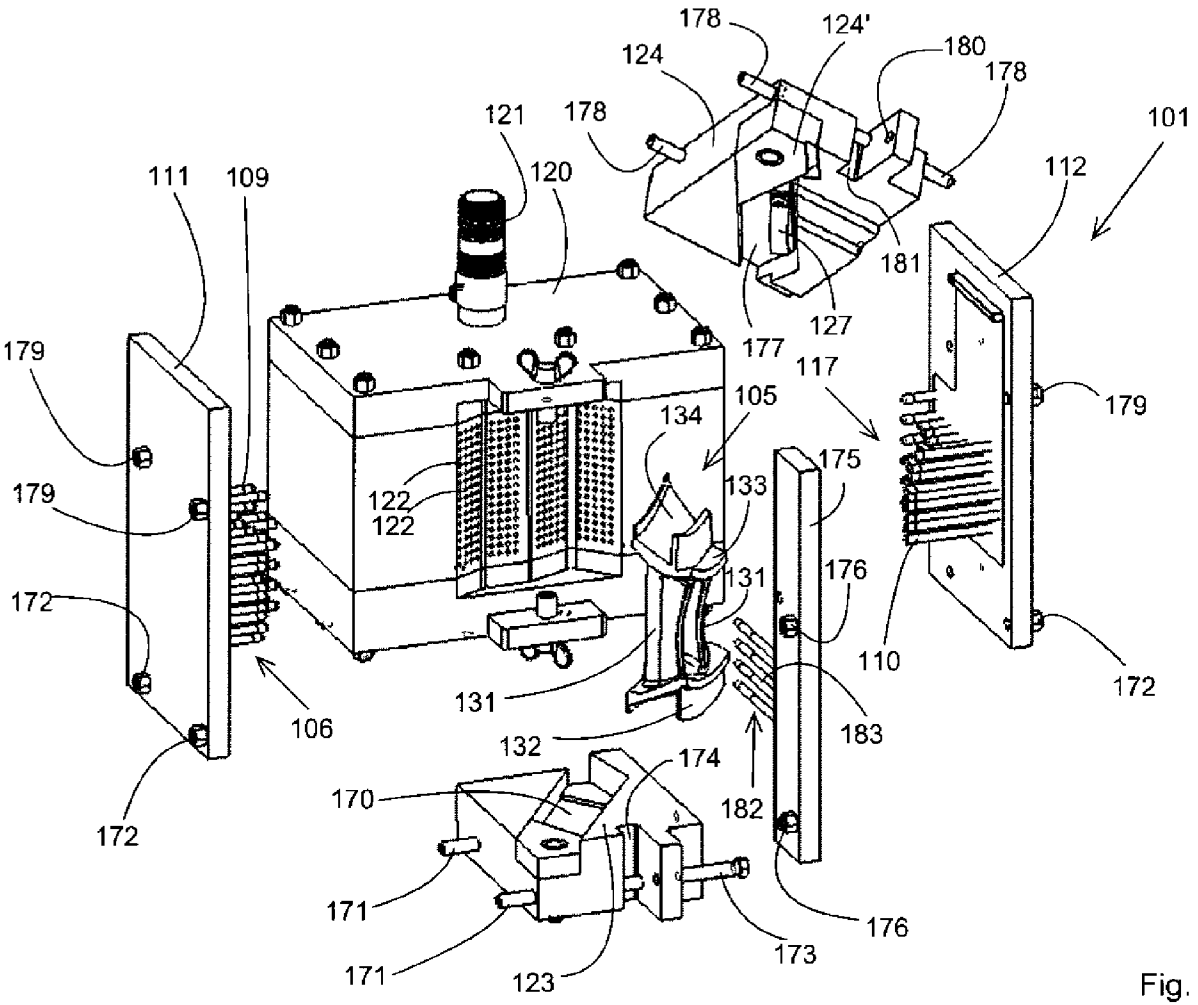
Figure 8:
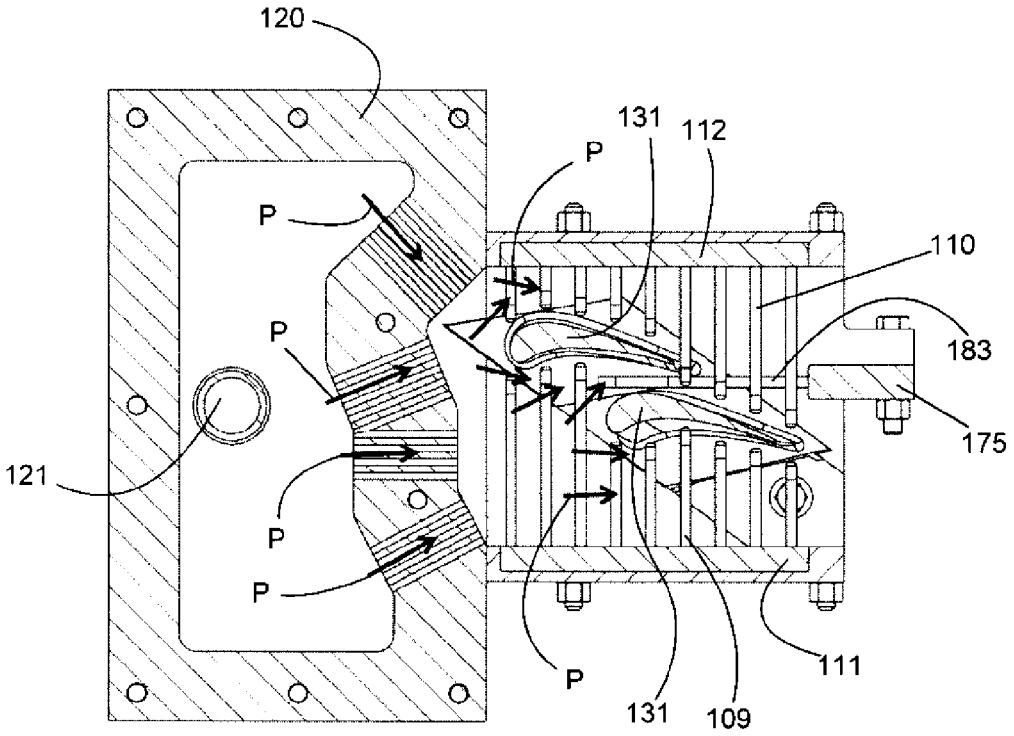
Figure 9:
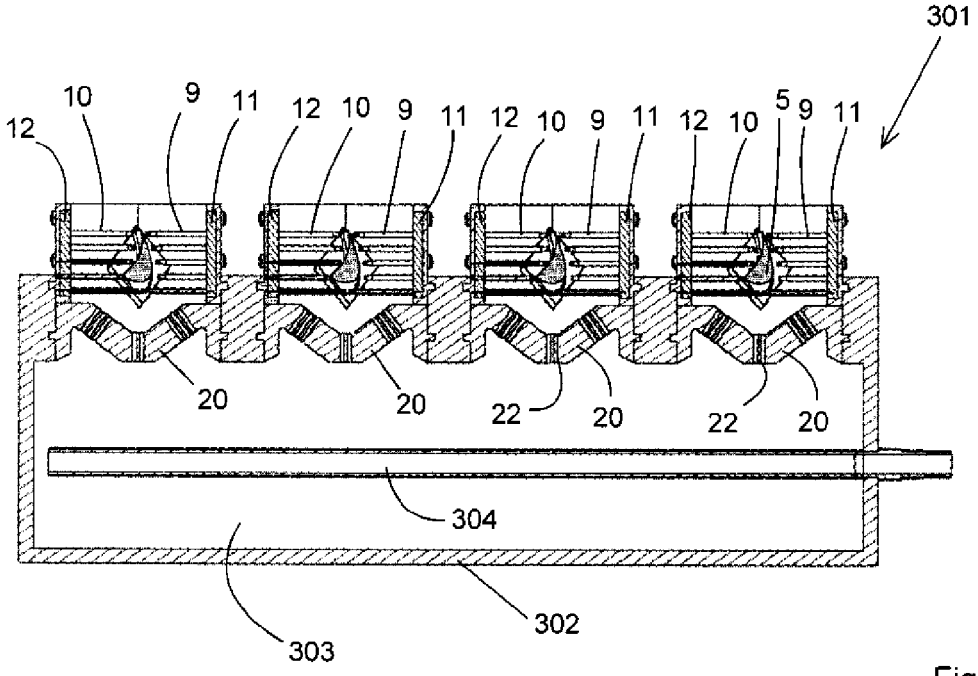
Figure 10A:
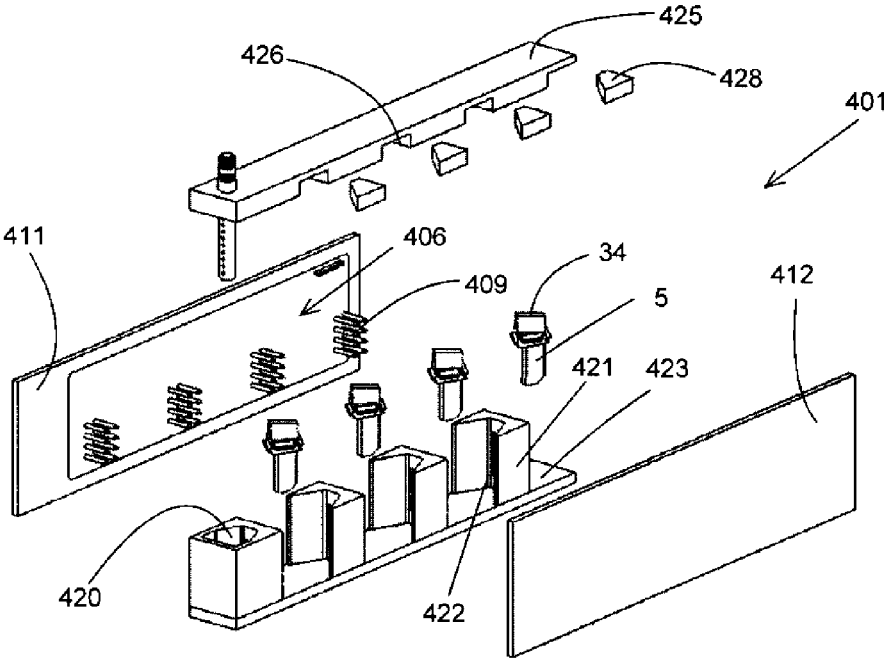
Figure 10B:
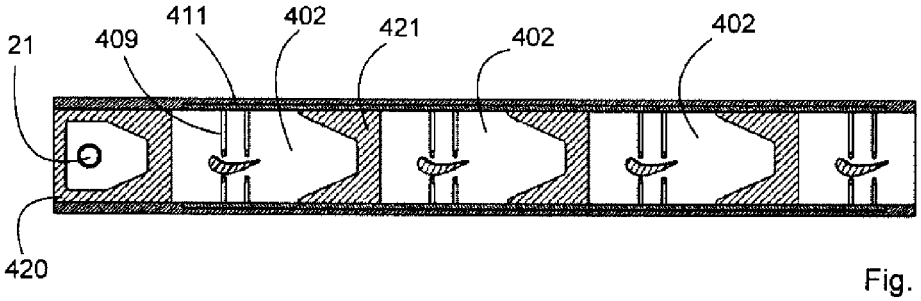
Figure 10C:
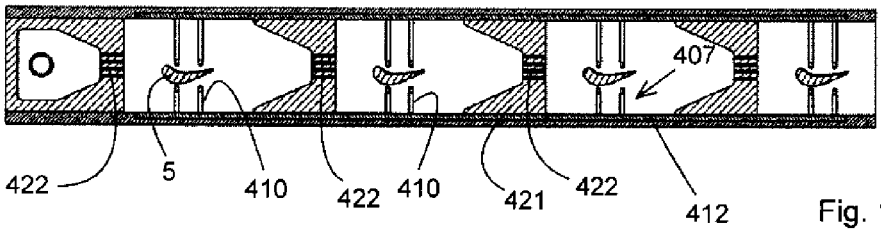

The invention will now be explained in more detail with reference to the drawing, in which:

FIG. 1 is a perspective view of a first embodiment of a device according to the invention, FIGS. 2A, 2B and 2C are an exploded view and front views of a part of the device as shown in FIG. 1, FIG. 3 is an enlarged side view of a pan of the device as shown in FIG. 1, FIG. 4 is a cross section of a holder of a device according to the invention, FIGS. 5A and 5B are perspective views of a turbine blade with an arrangement of electrodes according to the prior art and according to the invention, FIGS. 6A and 6B-6D are front and rear views of turbine blades processed by means of the arrangement of electrodes as shown in FIGS. 5A and 5B respectively, FIG. 7 is an exploded view of a part of a second embodiment of a device according to the invention, FIG. 8 is an enlarged side views of a part of the device as shown in FIG. 7, FIG. 9 is a cross section of a of a third embodiment of a device according to the invention, FIG. 10A-10C are an exploded view and two cross sections of a fourth embodiment of a device according to the invention.

Figure 11:
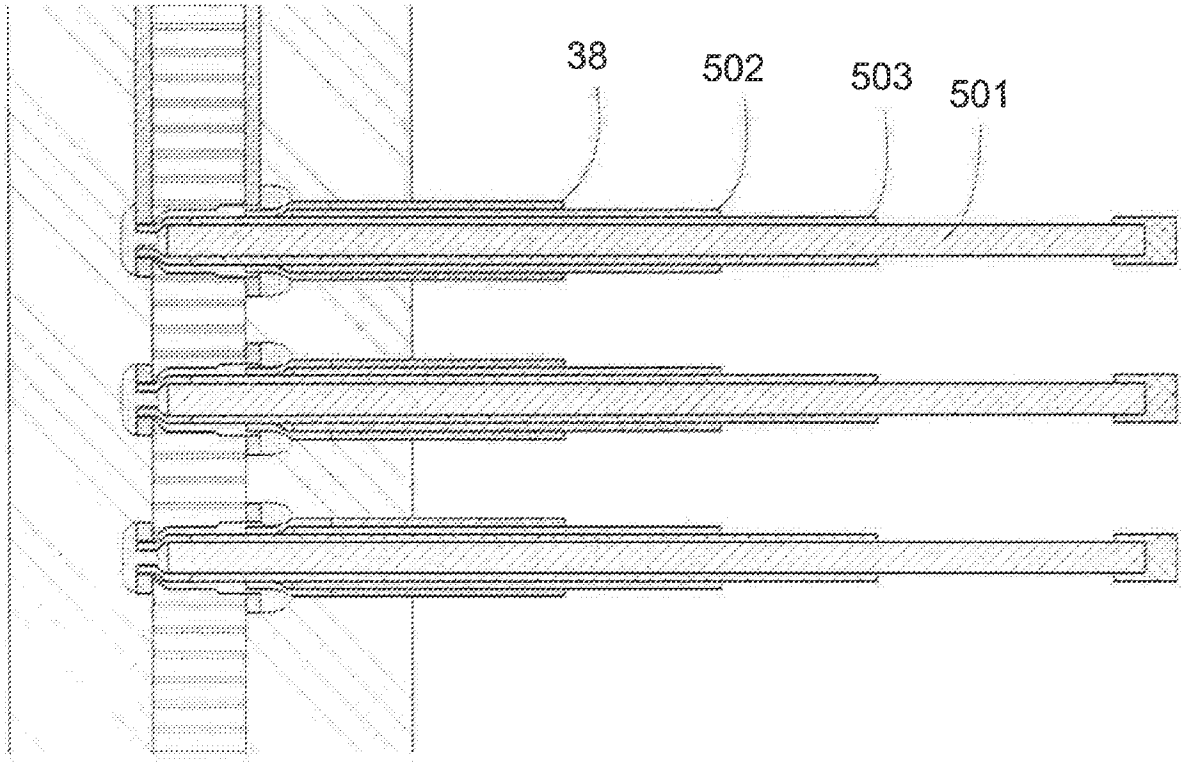

FIG. 11 is an enlarged side view of a part of the device as shown in FIG. 7.

Like parts are indicated by the same numerals in the various figures.

FIGS. 1-3 show different views of a first embodiment of a device 1 according to the invention. The device 1 comprises a chamber 2 filled with an electrolyte 3, means 4 for supporting a turbine blade 5 that is to be processed in said chamber 2 and two sets 6, 7 of electrodes 9, 10. The electrodes 9 of the first set 6 extend parallel to each other. Also the electrodes 10 of the second set 7 extend parallel to each other. The electrodes 9 extend parallel to the electrodes 10 as well but the electrodes 9, 10 extend in opposite directions towards each other.

Each set 6, 7 of electrodes 9, 10 is mounted in a holder 11, 12 by means of which each electrode 9, 10 or a group of electrodes 9, 10 is connected to a separate current source in a manner as disclosed in WO2010032130A2 of applicant.

Each holder 11, 12 is electrically connected by means of a flexible cable 13, 14 via a control unit 15 to a computer 16. By means of the computer 16 and the control unit 5 the desired currents are provided to the electrodes 9, 10.

The device 1 is further provided with a pump 17 and conducts 18, 19 for pumping the electrolyte 3 through the spaces between the individual electrodes 9, 10 and between the electrodes 9, 10 and the turbine blade 5.

As can be best seen in the exploded view of FIG. 2A, the device 1 comprises an electrolyte directing device 20 provided with an inlet opening 21 which is connected to the conduct 18 and with a large number of outlet openings 22 directed towards the electrodes 9, 10 and the turbine blade 5. The holders 11, 12 are positioned on opposite sides of the device 20. A bottom plate 23 is located between the bottom of the holders 11, 12 and the device 20. A two part top plate 24 forming means 4 is located between the top of the holders 11, 12 and the device 20. A first part 25 of the top part 24 is provided with a slot 26 and a metal spring 27 located inside the slot 26. The second part 28 of the top plate 24 is provided with bolts 29 which can be inserted in corresponding threaded holes 30 of the first part 25.

The turbine blade 5 comprises a blade 31, a foot 32 near one end of the blade 31, a root platform 33 near the other end of the blade 31 and a root part 34 located on an opposite side of the root platform 33 than the blade 31.

To mount a turbine blade 5 between the electrodes 9, 10, the root part 34 is slit into the slot 26 of the first part 25, where after the second part 28 is connected to the first part 25 to enclose the root part 34. When sliding the root part 34 inside the slot 26, the metal spring 27 comes in contact with the root part 34. The metal spring 27 is electrically connected to a metal screw on top of the first part 25 so that the turbine blade 5 can be connected to the negative pole of the control unit 15 if the electrodes 9, 10 receive a positive current or vice versa.

As is clearly visible in the FIGS. 2B and 2C, a part of the electrodes 9, 10 are located with fixed spacings $\Delta x$, $\Delta y$ on nodes 35 of a raster pattern 36, whilst another part of the electrodes 9, 10 are located at a position shifted with respect to the nearest node 35 of the raster pattern 36. The nodes 35 of the raster pattern 36 are located on lines extending in two different directions extending perpendicular to each other. In x-direction the nodes 35 are located with fixed spacings $\Delta x$, whilst in y-direction the nodes 35 are located with fixed spacings $\Delta y$. The nodes 35 with the regular spacings between them form a rectangular matrix. It is also possible that the at least two different directions enclose an angle with each other of more than 0 degrees but less than 90 degrees, so that the nodes 35 are located at the corners of a parallelogram. There are also a number of nodes 35, such as node 35' near which node 35' no electrode 9 is located, whilst near node 35" there are two electrodes 9. The position of all the electrodes 9, 10 with respect to the raster pattern 36 is determined by means of computer simulations whereby the expected layer thickness is calculated taking into account amongst other the shape of the object to be plated, the dimensions of the electrodes and the maximum current on each electrode being limited to realistic values in the order of for example 100 mA per electrode, while approaching as closely as possible a desired layer thickness distribution over the entire surface area of the object that is to be plated. For such computer simulations, the methods as described in WO200801900, WO2008152506 or WO2010032130 of applicant can be used. If the difference between a calculated expected layer thickness of the layer to be deposited and the desired layer thickness exceeds a predetermined value, the positions of the electrodes are recalculated and the electrodes are being rearranged. In such a case the fixed spacings Δx, Δy of the raster pattern 36 can be amended, the dimensions and number of electrodes can be changed etc.

As for example can be seen in FIGS. 2A and 2B, the diameter of the electrodes directed towards the root part 34 is smaller than the diameter of the electrodes directed towards the blade 31. The diameter of the pen-shaped electrodes is in the range of 1-5 mm. The number of the electrodes used in each holder 11, 12 is typically between 20 and 100 depending on the size of the turbine blade 5. The size of a turbine blade can range from about 20 mm to over 200 mm from foot 32 to root platform 33. The center-to-center distance between the electrodes can range from about 5 mm up 50 mm.

As can be seen in FIG. 3, the pen-shaped electrodes 9, 10 are electrically insulated with insulation 38 on the outer side except for the tip end 39 extending towards the turbine blade 5. The tip end 39 can be rounded. The distance between the tip ends 39 and the surface of the turbine blade 5 can be equal for all electrodes 9, 10 or can be varied if desired.

As is shown in FIG. 4, the holder 11 (as well as holder 12) is provided with copper shoes 40. Each shoe 40 is provided with a titanium cylinder 41 with internal threads. Each electrode 9, 10 is provided with external threads near the end opposite to the tip end 39 to be able to be threaded in the cylinder 41. This makes it possible to easily replace an electrode by another electrode in case that the electrode needs to be cleaned or that an electrode with other dimensions like another diameter or length is being needed. In case that no electrode is needed on a certain position, a plastic screw 42 can be inserted into the cylinder 41 to close the cylinder 41 off. The copper shoes 40 form part of a printed circuit board on the holder 11, which makes it possible to connect each electrode 9 (or group of electrodes) to its own current source.

FIG. 5A shows a set 45 of electrodes 46 according to a prior art device, whereby all electrodes 46 are located on a node of a raster pattern with the same distance between all electrodes 46. With such an arrangement, there will be electrodes located opposite the foot 32. These electrodes with position A6,1; A6,2 for example, will cause a layer to be formed on the root 32, whilst no layer is needed on the foot 32. On the other hand, no layer will be formed on the root 34. Even more important, with the arrangement as shown in FIG. 5A, the layer formed near the end of the blade 31 close to the root platform 33 will not have the desired thickness. In case that the required layer thickness is obtained near the root platform 33, the layer thickness on the blade 31 close to the electrodes with positions A1,1-A1,5 will be too thick and of poor quality.

FIG. 5B shows a set 6 with electrodes 9 according to the invention, wherein the positions of the electrodes have been optimized so that a desired layer thickness with the desired quality is obtained on the turbine blade 5. No electrodes are located near the positions A6,1 and A6,2, The electrodes A1,1-A1,5 are located on positions which are shifted with respect to nodes of the raster pattern and additional electrodes are located on positions B1-B6.

FIG. 6A shows a front view and a rear view of a turbine blade 5 which is provided with a platinum layer with the arrangement of electrodes as shown in FIG. 5A. The numbers as shown on the turbine blade 5 is the layer thickness in micrometer. To obtain this result, plating took place during 25 minutes with an average cathodic current density of −160 A/m2. As can be seen in FIG. 6A, the thickness varies a lot over the blade 31. During the plating process, 1.51 gram was deposited but the minimum thickness requirements of 3 micron were not met over the whole blade 31.

FIG. 6B shows a front view and a rear view of a turbine blade 5 which is provided with a platinum layer with the arrangement of electrodes as shown in FIG. 5B. The current values were optimized for generating a uniform deposit thickness over the blade surfaces. The plating time was 13 minutes and 40 seconds with an average cathodic current density of −160 A/m2. The deposited amount was only 0.81 gram whilst the minimum thickness requirements of 3 micron were met over the entire blade surface area.

FIG. 6C shows a front view and a rear view of a turbine blade 5 which is provided with a platinum layer with the arrangement of electrodes as shown in FIG. 5B. The current values were optimized for generating a deposit thickness over the blade surfaces that decreases from the leading edge 48 to the trailing edge 49 of the blade 31. The plating time was 13 minutes and 40 seconds with an average cathodic current density of −106 A/m2. The deposited amount was 0.63 gram being less than by FIG. 6B whilst the specifications of 3 micron at leading edge gradually decreasing to 1 micron at trailing edge were also met.

FIG. 6D shows a front view and a rear view of a turbine blade 5 which is provided with a platinum layer with the arrangement of electrodes as shown in FIG. 5B. The current values were optimized for generating a deposit thickness over the blade surfaces that is larger on the concave side 50 than on the convex side 51. The plating time was 13 minutes and 40 seconds with an average cathodic current density of −80 A/m2. The deposited amount was 0.58 gram being less than 0.63 gram of FIG. 6C whilst the specifications of 3 micron at the concave side 50 and no specification at the convex side 51 were also met.

It is clear that by the device and method according to the invention, any desired layer thickness and thickness variation over the surface of the object to be processes can be realized due to the re-arrangement of the electrodes to the desired positions preferably combined with providing predetermined different desired currents to each electrode or groups of electrode.

FIGS. 7 and 8 show a second embodiment of a device 101 according to the invention. The device 101 comprises the same elements as the device 1 as shown in FIG. 1, except for another electrolyte directing device 120, other sets of electrodes and other means for supporting the object.

The object to be supported by the device 101 is a double turbine blade 105 comprising two blades 131 which are connected to each other at the foot 132 and at the root platform 133.

The holders 111, 112 are similar to the holders 11, 12 and comprises sets 106, 107 of electrodes 109, 110.

The bottom plate 123 is provided with a recess 170 for receiving the foot 132. The bottom plate 123 and holders 111, 112 are provided with holes to be able to assemble the bottom plate 123 and the holders 111, 112 together by means of threaded rods 171 and nuts 172. The bottom plate 123 is provided with a passage 174 for a third holder 175. When the third holder 175 is located in the passage 174, the third holder 175 is connected to the bottom plate 123 by means of a bolt 173 extending through a hole in the third holder 175 and into the bottom plate 123 and into a nut 176.

The top plate 124 is provided with a recess 177 for receiving the root part 134. The recess 177 is closed by means of a removable hook piece 124' of the top plate 124. A spring 127 is located in the recess 177 for making electrical contact with the root part 134. The top plate 124 is provided with threaded rods 178 which can be inserted in holes in the holders 111, 112 and to fasten the holders 111, 112 with nuts 179. The top plate 124 is provided with a passage 181 for the third holder 175. When the third holder 175 is located in the passage 181, the third holder 175 is connected to the top plate 124 by means of a bold extending through a hole in the third holder 175, a hole 180 in the top plate 124 and into a nut 176.

The most important difference between the device 1 and the device 101 is that the device 101 comprises the third holder 175 with a third set 182 electrodes 183 extending parallel to each other but perpendicular to the electrodes 109, 110. As can clearly be seen in FIG. 8, the electrodes 183 extend between the two blades 131 which area is not accessible for the electrodes 109, 110. The electrodes 183 cross the electrodes 110 but do not make electrical contact to them.

The electrode 183 is insulted over its length which is not opposite a surface of the turbine blade but will be exposed over a much larger length than the electrodes 109, 110. Furthermore, the pen-shaped electrode 183 may comprise a pin-shaped inner electrode 501, a tube-shaped outer electrode 502 and an insulating layer 503 located between the inner electrode 501 and outer electrode 502, whereby different currents can be imposed on the inner and outer electrode 501,502. See FIG. 11. If desired the pen-shaped electrode may comprise a number of tube-shaped electrodes located coaxial wherein the length of the tube-shaped electrode is longer as it is located closer to the central axis of the pen-shaped electrode 183. The pen-shaped electrode 183 might also be bended in order to follow more closely the center line between the two blades for the configuration of FIG. 8. This would lead to electrode 183 with front and back end being bended downwards.

In FIG. 8 the direction of the forced flow of electrolyte is indicated by means of arrows P. The flow is preferably partly directed towards the leading or trading edge of the blade.

FIG. 9 shows a third embodiment of a device 301 according to the invention. The device 301 comprises four units as shown in FIG. 2A-2C, connected to each other. The passages 22 of the electrolyte directing devices 20 open on a side directed away from the electrodes 9, 10 in a common chamber 302 being filled with electrolyte 303 via conduct 304. With the device 301 four single blades 5 can be processed at the same time and with the same electrolyte at the same temperature using a single pump and conduct. In case that all sets 6 and all sets 7 are identical and the electrodes 9, 10 thereof are provided with the same current profiles, the layers on the turbine blades 5 will be identical. The holders 11, 12 can be hinged to the devices 20 which allows for easy mounting and removal of the object without touching the electrodes.

FIG. 10A-10C show a fourth embodiment of a device 401 according to the invention. The device 401 comprises four units as shown in FIG. 2A-2C, connected to each other. A holder 411 comprises four sets 406 of electrodes 409, whilst a holder 412 comprises four sets 407 of electrodes 410. The device 401 comprises near one end of the holders 411, 412 an electrolyte directing device 420. Furthermore a number of separating elements 421 are located between sets 406 of electrodes 409. The electrolyte directing device 420 and each separating element 421 are mounted on a bottom plate 423 and are closed on the top side by means of a top plate 425. The top plate 425 is provided with four slots 426 which are to be closed by means of parts 428 after the turbine blades 5 have been inserted with their root parts 34 into the slots 426. The electrolyte directing device 420 and each separating element 421 are provided with passages 422 to control the flow of electrolyte from one chamber 402 to the next chamber 402.

The devices according to the invention can also be used for electrochemically removing a layer from an object.

The object can be a turbine blade but also any kind of object with any arbitrary of shape.

If desired more sets of electrodes can be used, wherein for example the electrodes of three different sets extend respectively in x, y and z direction, or by adding a further fourth, fifth or even sixth set with the pen electrodes being parallel to the ones of the first, second, respectively third set of electrodes but opposite in direction.

The invention claimed is:

1. A device suitable for electrochemically processing an object, which device is at least provided with a chamber that is to accommodate an electrolyte, means for supporting the object that is to be processed in said chamber, a holder comprising at least one set of electrodes extending parallel to each other, which electrodes of said at least one set of electrode are located in said chamber such that during operation the electrodes of said at least one set of electrodes are located opposite a surface of said object that is to be processed, as well as a control unit for providing an electric current between the object that is to be processed and the electrodes of said at least one set of electrode, wherein the holder comprises at least one matrix pattern whereby two principle patterning directions of the matrix pattern extend perpendicular to each other or enclose an angle with each other of more than zero degrees but less than ninety degrees, the matrix pattern comprising a number of nodes with fixed spacings between the nodes in at least two different directions, wherein a number of electrodes of said at least one set of electrodes is arranged on the nodes of the matrix pattern, wherein at least one electrode of said at least one set of electrodes is located at a position that deviates with respect to the matrix pattern.

2. A device according to claim 1, wherein the device comprises at least two sets of electrodes, wherein the electrodes within one set extend parallel to each other, wherein the electrodes of the first and second set extend in different directions.

3. A device according to claim 2, wherein the electrodes of the first and second set extend in opposite directions but parallel to each other.

4. A device according to claim 2, wherein the device comprises at least three sets of electrodes, wherein the electrodes within one set extend parallel to each other, wherein the electrodes of the first, second and third set extend in different directions, whereby the electrodes of the first and second set extend in opposite directions but parallel to each other, wherein the electrodes of the third set extend substantially perpendicular to the electrodes of the first and second set.

5. A device according to claim 4, wherein at least one of the electrodes of the third set crosses the electrodes of the first or second set.

6. A device according to claim 1 wherein the diameter of the electrodes is in the range of 1-5 mm, wherein the center-to-center distance between the electrodes is in the range of 5-50 mm.

7. A device according to claim 1, wherein the electrodes have different lengths.

8. A device according to claim 1, wherein a longitudinal axis of at least one electrode is curved.

9. A device according to claim 1, wherein at least one electrode is pen-shaped, wherein the pen-shaped electrode is electrically insulated on the outer side except for the end extending towards the object to be processed.

10. A device according to claim 1, wherein at least one electrode is pen-shaped, wherein the pen-shaped electrode comprises a pin-shaped inner electrode, a tube-shaped outer electrode and an insulating layer located between the inner electrode and outer electrode.

11. A device according to claim 10, wherein the inner electrode extends outside the outer electrode, wherein the inner electrode and outer electrode are each connected to a separate current source.

12. A device according to claim 1, wherein the device comprises means to force the electrolyte to flow between the electrodes within one set.

13. A device according to claim 1, wherein the device is provided with a separate current source for each individual electrode or group of electrodes such that the electric currents originating from the separate current sources can be supplied by the control unit to at least a number of said individual electrodes or a number of said groups of electrodes separately and in accordance with predetermined current profiles over the plating time during the electrochemical processing of the object so as to realize a predetermined desired current density distribution across the object.

14. A device according to claim 1, wherein the electric potential on each electrode can be measured when a predetermined current is injected through the electrode, wherein the device is further configured to determine whether the measured value corresponds to an expected value.

15. A holder suitable for a device for electrochemically processing an object, which holder comprises at least one set of electrodes extending parallel to each other, wherein the holder comprises at least one matrix pattern whereby two principal patterning directions of the matrix pattern extend perpendicular to each other or enclose an angle with each other of more than zero degrees but less than ninety degrees, the matrix pattern comprising a number of nodes with fixed spacings between the nodes in at least two different directions, wherein a number of electrodes of said at least one set of electrodes is arranged on the nodes of the matrix pattern, wherein at least one electrode of said at least one set of electrodes is located at a position that deviates with respect to the matrix pattern.

* * * * *